US007756717B2

(12) United States Patent
Dayal et al.

(10) Patent No.: US 7,756,717 B2
(45) Date of Patent: Jul. 13, 2010

(54) LUBRICANT MANAGEMENT METHOD FOR A VEHICLE

(75) Inventors: Bhupinder Singh Dayal, Fairview, PA (US); John Paul Kralik, Hudson, OH (US); Keith A. Condran, Hudson, OH (US); Robert Douglas Cryer, Erie, PA (US); Thomas Charles Sonney, Wattsburg, PA (US)

(73) Assignee: General Electric Company, Schenectady, NY (US)

( * ) Notice: Subject to any disclaimer, the term of this patent is extended or adjusted under 35 U.S.C. 154(b) by 1521 days.

(21) Appl. No.: 10/277,260

(22) Filed: Oct. 22, 2002

(65) Prior Publication Data

US 2003/0146050 A1 Aug. 7, 2003

Related U.S. Application Data

(60) Provisional application No. 60/354,658, filed on Feb. 5, 2002.

(51) Int. Cl.
*G06Q 10/00* (2006.01)
*G06Q 30/00* (2006.01)

(52) U.S. Cl. ..... 705/1; 141/65; 141/98; 141/192; 184/1.5

(58) Field of Classification Search ..... 705/1, 705/7, 8, 9, 10; 702/84, 85, 22; 184/1.5, 184/3.1, 3.2, 6.4; 141/65, 98, 192
See application file for complete search history.

(56) References Cited

U.S. PATENT DOCUMENTS

| | | | | |
|---|---|---|---|---|
| 5,273,134 | A | 12/1993 | Hegemier et al. | |
| 5,749,339 | A | 5/1998 | Graham et al. | |
| 5,881,688 | A | 3/1999 | Graham et al. | |
| 5,964,318 | A * | 10/1999 | Boyle et al. | 184/1.5 |
| 5,970,942 | A | 10/1999 | Koeberlein et al. | |
| 6,082,322 | A | 7/2000 | Graham et al. | |
| 6,192,320 | B1 * | 2/2001 | Margrey et al. | 702/84 |
| 6,213,080 | B1 | 4/2001 | Marsh et al. | |
| 6,568,436 | B1 * | 5/2003 | Matthews et al. | 141/65 |
| 6,802,810 | B2 * | 10/2004 | Ciarniello et al. | 600/300 |
| 2002/0095585 | A1 * | 7/2002 | Scott | 713/185 |
| 2002/0118355 | A1 * | 8/2002 | Worthington et al. | 356/72 |

* cited by examiner

*Primary Examiner*—Dean Tan Nguyen
(74) *Attorney, Agent, or Firm*—Robert Wawrzyn, Esq.; Terry M. Sanks, Esq.; Beusse Wolter Sanks Mora & Maire, P.A.

(57) ABSTRACT

A system (10) for ensuring the quality of lubricating oil in an engine of a locomotive without the need for specialized diagnostic and fluid handling systems on the locomotive. A test portion (28) of lubricating oil is removed from the engine and is analyzed at an oil analysis center (26) to determine an oil quality parameter (32). The oil quality parameter is used as an input to a calculator (34) to determine a quantity of oil (36) that must be replaced by fresh oil during a current maintenance outage in order to ensure that the engine oil quality will remain acceptable throughout a forthcoming operating period. In this manner, a complete change-out of the lubricating oil may be delayed or avoided. The oil replacement decision and quantity is communicated to a service center (18) via a communications link such as the Internet (40) prior to the arrival of the locomotive at the service center. The used oil may be removed from the engine using a portable transfer device and mixed with fuel in a fuel storage tank for subsequent refueling of other locomotives.

15 Claims, 2 Drawing Sheets

LUBRICANT MANAGEMENT METHOD FOR A VEHICLE

CROSS-REFERENCE TO RELATED APPLICATION

This application claims benefit of the Feb. 5, 2002, filing date of U.S. provisional application No. 60/354,658.

FIELD OF THE INVENTION

This invention relates to the field of lubricating oil management systems for the internal combustion engine of a vehicle.

BACKGROUND OF THE INVENTION

An internal combustion engine relies upon a lubricating fluid, typically natural or synthetic oil, to reduce friction between moving parts and to remove heat from critical components of the engine. It is well known that the desirable properties of such fluids will degrade with continued operation of the engine, due to chemical changes in the fluid itself as well as the accumulation of contaminants that cannot be successfully filtered out of the fluid.

Many schemes are used to maintain the quality of lubrication in the internal combustion engine of a vehicle. Lubricating oil may be removed and replaced after a predetermined time period, after a predetermined number of operating hours, or after a predetermined number of miles of travel of the vehicle. Such schemes are necessarily conservative to avoid engine damage during worst-case operating conditions, such as high temperature, high speed, high altitude, and dusty environment operation. Such predetermined interval schemes result in unnecessarily frequent oil changes for most normal operating situations.

U.S. Pat. No. 5,749,339 describes a system for automatically replacing a portion of the lubricating oil in an internal combustion engine of a vehicle at a rate influenced by the fuel consumption of the engine. The removed portion of the oil is consumed in the engine by mixing it with the fuel supply for the engine, and fresh oil is added from an on-board supply. U.S. Pat. No. 5,964,318 describes a similar on-board lubricating oil quality management system that controls the amount of oil removed and replaced in response to a continually sensed oil quality parameter. The on-board sensors may be used to determine oil temperature, pressure, dielectric or viscosity values. An on-board controller receives the sensor signal as an input, and it automatically controls an on-board valve for regulating the amount of oil removed from and added to the engine. The controller may also be programmed to consider variables such as the number of starts, run time or distance and fuel usage. Such on-board systems are useful for extending the time period between oil changes for an engine; however, they require expensive on-board diagnostic and fluid systems.

It is common practice in the railroad industry to perform a laboratory oil analysis on a test sample of lubricating oil from a locomotive diesel engine, and to base an oil change/no-change decision on the results of the oil analysis. The oil analysis performed on the test sample is generally more thorough than the type of on-board measurements described in the prior art '318 patent. If the as-measured quality of the lubricating oil is determined to be below a predetermined threshold, the locomotive is scheduled for a complete engine oil change. The quality parameters may include pentane insolubles, viscosity, and total base number (TBN). The quality parameter(s) set point levels used to make this decision are selected to ensure that the oil quality will not drop to an unacceptable level at any time before the next scheduled service outage for the locomotive, typically ninety (90) days hence. Accordingly, it is often necessary to change lubricating oil that is still performing adequately in order to avoid the possibility that it will fall below a quality threshold during the next engine-operating period.

BRIEF DESCRIPTION OF THE INVENTION

A method for maintaining the quality of lubricant in the engine of a mobile vehicle is described herein as including: planning operation of a mobile vehicle for a number of operating periods separated by a respective number of maintenance periods; removing a test portion of lubricant from an engine of the mobile vehicle during a first of the maintenance periods; determining at least one quality parameter associated with the test portion of lubricant; using the at least one quality parameter to determine a replacement quantity of lubricant that must be removed from the engine and replaced with fresh lubricant in order to maintain a desired engine lubricant quality parameter in the engine until a second of the maintenance periods; and removing the replacement quantity of lubricant from the engine and replacing it with fresh lubricant. The method may further include: removing the test portion of lubricant from the engine at a first maintenance location; delivering the test portion of lubricant to an analysis location remote from the first maintenance location; and communicating the replacement quantity to one of the first maintenance location and a second maintenance location for performing the steps of removing the replacement quantity of lubricant and replacing it with fresh lubricant. A global information network may be used during the step of communicating. The method may include transferring the replacement quantity of lubricant from the engine to a fuel tank of a mobile vehicle. The method may further include transferring the replacement quantity of lubricant from the engine to a storage apparatus to create a mixture of fuel and replaced lubricant; and transferring at least a portion of the mixture of fuel and replaced lubricant to the fuel tank.

A system for maintaining the quality of lubricant in an engine of a mobile vehicle during a period of operation between successive service outages is described herein as including: a lubricant analysis device for determining at least one quality parameter associated with a test portion of lubricant removed from an engine of a mobile vehicle; and a calculator responsive to the at least one quality parameter for determining a replacement quantity of lubricant to be removed from the engine and replaced with fresh lubricant sufficient to maintain a desired engine lubricant quality parameter in the engine during a next period of operation of the engine until a next service outage. The lubricant analysis device and the calculator may be connected to an information network for communicating the at least one quality parameter and the replacement quantity of lubricant. The system may further include a service location where the mobile vehicle will have the replacement quantity of lubricant removed and replaced with fresh lubricant, the service location connected to the information network for receiving the replacement quantity of lubricant. The lubricant analysis device may be a hand-held permittivity sensor. The system may further include a tank for receiving the replacement quantity of lubricant and for receiving fuel to create a mixture used to fuel an engine.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
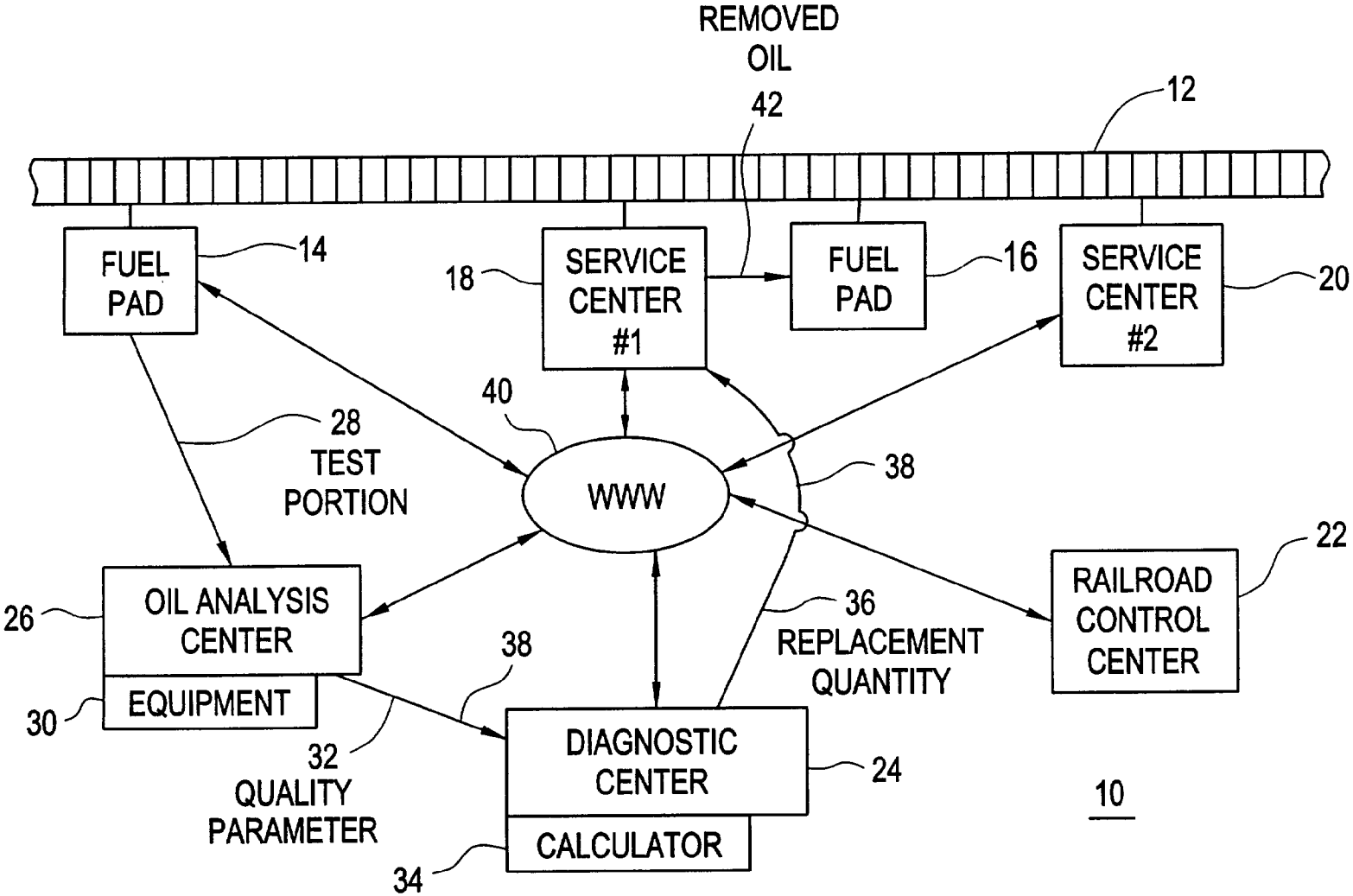
FIG. 1 illustrates a system for maintaining the quality of lubricant in an engine of a vehicle. The system includes, among other elements, an oil analysis center, a vehicle service center, and a diagnostic center, all interconnected by a global information network.

FIG. 1 illustrates one embodiment of a system 10 for maintaining the quality of lubricant in an engine of a vehicle during a period of operation between successive service outages. The engine may be a diesel internal combustion engine of a locomotive (not shown) operating on a rail system 12. The rail system 12 includes a plurality of fueling locations, such as fuel pads 14, 16 and a number of service locations, such as service centers 18, 20. A fuel pad 16 may be co-located and associated with a service center 18. The operation of locomotives and trains of rail vehicles along the rail system 12 may be controlled from a railroad control center 22. A diagnostic center 24 may be associated with the rail system 12 and the railroad control center 22 for performing a variety of technical and economic diagnostic functions designed to improve the operating efficiency of the rail system 12. One such diagnostic center 24 operated by the assignee of the present invention is located in Erie, Pa.

The system 10 also includes an oil analysis center 26 where a test portion 28 of lubricating oil from a locomotive may be taken for a complete chemical and physical analysis. The oil analysis center 26 may be located at any convenient location, preferably at a location that can service a large number of clients in an economical fashion. The oil analysis center 26 may be located at one of the fuel pads 14, 16, at one of the service centers 18, 20, at the diagnostic center 24, at the railroad control center 22, or most likely at an independent location. The oil analysis center 26 may contain a complete line of analysis equipment 30 as may be known now or may become known in the art, for example, a kinematic viscometer for measuring viscosity; atomic absorption and inductively coupled plasma (ICP) instruments for detecting metals indicative of engine/bearing wear; potentiometric titration instruments for TBN and TAN; filtration or centrifuge techniques for measuring pentane insolubles; thermal gravimetric analysis (TGA) for soot/carbon measurements; and infrared spectroscopy for measuring soot, TBN and TAN. The chemical and physical properties of the test portion 28 of lubricating oil are determined at the oil analysis center 26, and at least one oil quality parameter 32 is determined. The quality parameter 32 may be, for example, the same parameter that is used in the prior art as the basis for the known oil change/no-change decision, e.g. pentane insolubles, TBN and viscosity. The at least one oil quality parameter 32 is communicated to a calculator 34 typically associated with the diagnostic center 24. The calculator 34 is responsive to the oil quality parameter(s) 32 and is used for determining a replacement quantity of lubricant 36 to be removed from the engine and replaced with fresh lubricant that is sufficient to maintain one or more desired engine lubricant quality parameters in the engine during the next period of operation of the engine until the next service outage. The calculator 34 may be as simple as a look-up table or graph, or it may be a computer-implemented sequence of calculations embodied in a software program, such as a mechanistic or empirical process model that takes into account specific features of the lubricant, the engine (age, duty cycle, etc.), the locomotive design, the rail system 12, the season of operation, etc. For example, a conservatively high rate of deterioration of a quality parameter verses hours of operation may be developed from past experience with an engine. The calculator 34 may include a curve of the quality parameter verses hours of operation, together with a mechanism for locating the present quality parameter value on the curve, and for predicting remaining hours of operation until the quality parameter drops below a predetermined minimum value. If the quality of the lubricant is then predicted to remain acceptable during the entire following operating period, the calculator 34 will indicate that no lubricant will have to be replaced during the present service outage. If, however, it is projected that the quality of the lubricant will fall below the predetermined minimum value during the forthcoming operating period, a specific replacement quantity of lubricant 36 is calculated. The calculator may include equations for determining the amount of lubricant that must be removed and replaced by fresh lubricant in order to return the quality parameter to a sufficiently high value so that its predicted degradation during the following usage period will not result in a valued below the predetermined minimum value. The calculator 34 for implementing such steps may be a personal computer, hand-held calculator or other type of available hardware for implementing such process steps. By replacing only a predetermined quantity of the existing lubricant from the engine with fresh lubricant during the present outage, the quality of the lubricant in the engine will be improved to a point wherein it will remain acceptable during the entire forthcoming operating period. In this manner, a complete change of the lubricating oil may be delayed or eliminated, thereby reducing the total consumption of lubricant by the engine and lowering the overall cost and environmental impact of operation of the locomotive. This process may be repeated for each successive scheduled maintenance outage for the locomotive in order to ensure that the lubricating oil quality will remain acceptable for the respective following operating period. At some point, a decision may be made to change the entire quantity of lubricating oil in the engine, but such a complete change-out will likely be delayed as a result of the use of the system 10 and method described above.

The communication of the quality parameter 32 and/or replacement quantity 36 between the various elements of the system 10 may be by a direct link 38, such as U.S. mail or facsimile transmission, or it may be accomplished via connections to a global information network, such as the World Wide Web of the Internet 40. The use of the Internet 40 provides all of the interested parties with convenient access to such information. For example, if the oil test portion 28 is extracted at a fuel pad 14 shortly prior to a scheduled maintenance outage for the locomotive, the decision to replace a portion of the lubricating oil and the work order to accomplish such replacement may be communicated to a down-rail service center 18 where the locomotive will be serviced in advance of the locomotive arriving at the service center 18. Advance access to such information will allow the operations of the service center 18 to be optimized. Because lubricant will likely be lost from the engine through a variety of pathways, the fresh lubricant added to the engine will be an amount equal to the greater of the replacement quantity 36 and a quantity necessary to fill the engine to a desired level. From an oil quality perspective, as long as a quantity of fresh oil is added to the engine in a quantity at least equal to the removal quantity 36, the assumptions regarding the ongoing quality of the oil during the next operating interval will be satisfied.

Figure 2:
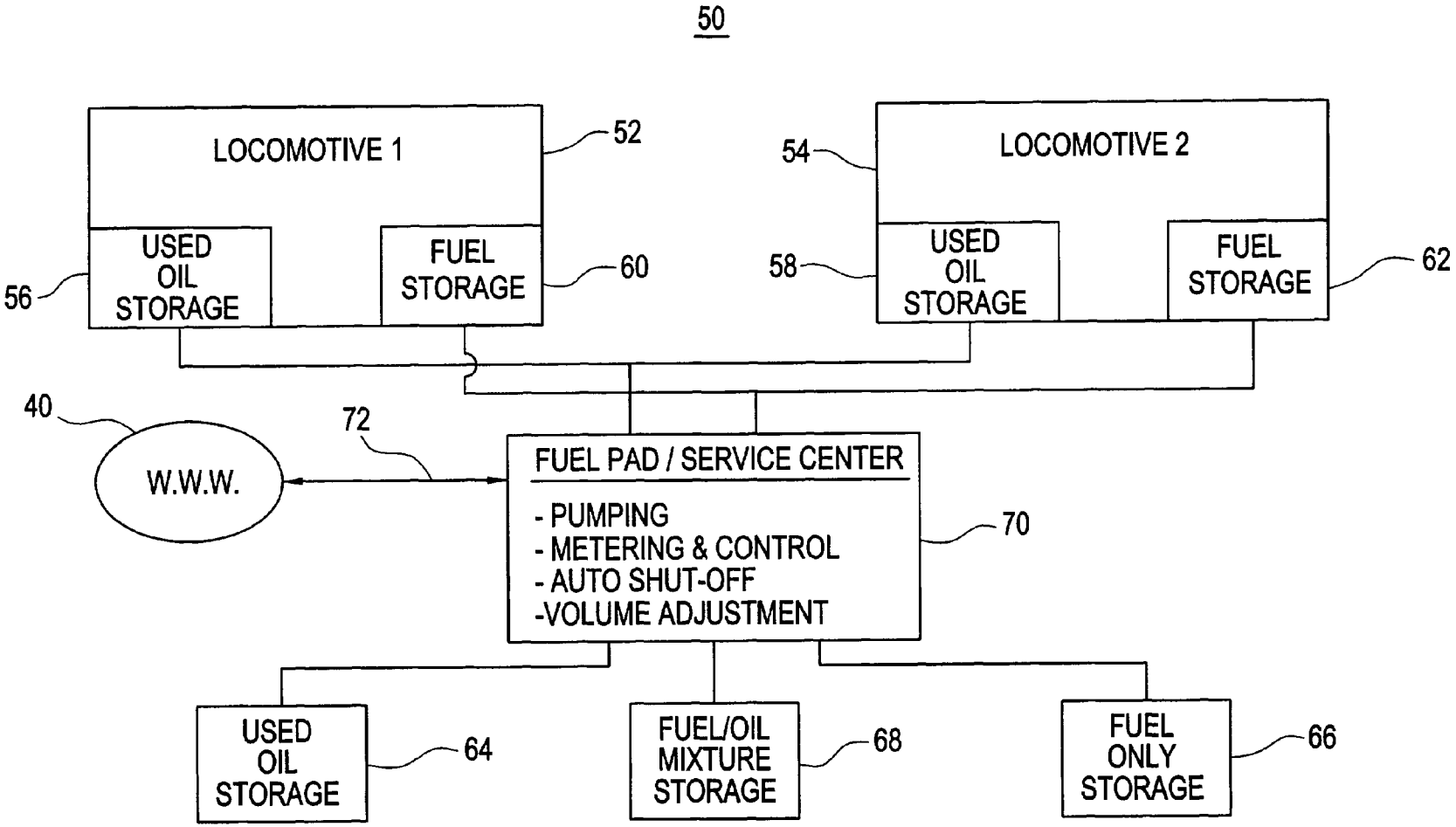
FIG. 2 illustrates a fuel/oil management system as may be located at a fuel pad or service center.

Used lubricant may be removed from the locomotive with a portable transfer device. The lubricant removed from the locomotive 42 may be transferred to the fuel tank of the locomotive, to the fuel tank of another locomotive, to a used-oil storage tank on a locomotive, to a used-oil storage tank associated with a fuel pad 16, or to a fuel storage tank associated with a fuel pad 16 for later consumption by a vehicle engine. FIG. 2 illustrates one embodiment of such a fuel/oil management center 50 servicing two locomotives 52, 54. Each locomotive 52, 54 may include a used oil storage tank 56, 58 in addition to the typical fuel tank 60, 62. The fuel/oil management center 50 also includes storage tanks for used oil storage 64, fuel storage 66 without oil, and fuel/oil mixture storage 68. The removed lubricant 42 is used to create a mixture of fuel and removed lubricant that may be used to refuel a vehicle. Such mixture may be made on-board a locomotive 52, 54 or at the fuel pad/service center location 70. The fuel/oil management center 50 includes appropriate mechanical and electrical systems for pumping, metering and control, automatic shutoff, and volume adjustment in the various storage tanks. Such systems may include a computerized inventory control system for tracking the quantity of used oil, the concentration of oil and oil contaminants in the fuel/oil mixture, the volumes available in various storage locations, etc. The system 50 may also include communication links 72 such as the Internet, telephone or facsimile transmission for conveying information that may be useful to other similar locations on the rail system, for communicating with various fuel and oil suppliers, and/or for communicating with the locomotives 52, 54 during operation. The control of such resources should include precautions not to exceed a predetermined concentration of lubricant in the fuel supply in order to avoid exceeding emissions limits.

The analysis equipment 30 may be located at a central oil analysis center 26, or alternatively, may be located proximate the location where the test portion 28 of oil is removed from the engine. In one embodiment, a hand-held sensor would be used, for example to measure a permittivity and temperature of the removed lubricant. Permittivity is an indicator of the quantity of contaminates entrained in a lubricant, and therefore, it is an indicator of the fitness of the lubricant for continued service. The temperature-compensated permittivity value would be used with a trending analysis to determine the replacement quantity 36. A trending analysis with a mechanistic or empirical model could be performed on the calculator 34 at the diagnostic center 24, with communication of the permittivity value being transmitted electronically, such as via the Internet 40, between the hand-held measurement equipment 30 and the diagnostic center 24. The replacement quantity 36 resulting from the trending analysis may also be communicated to service personnel electronically.

While off-board oil analysis equipment 30 may be the most practical with today's generation of electronic equipment, future systems may beneficially utilize at least some on-board sensing capability. For example, the hand-held permittivity sensor described above as being used off-board to obtain a permittivity measurement on the test portion 28 may alternatively be used on-board while the vehicle is being operated. Other economically practical on-board lubricant quality sensing systems may be identified for a particular application. The permittivity value or other measured oil quality parameter may then be transmitted electronically from the vehicle via any known communication system to the diagnostic center calculator 34. The lubricant removal or change decision may thus be made and communicated to an appropriate service center 18 prior to the arrival of the vehicle.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A method for maintaining the quality of lubricant in the engine of a mobile vehicle, the method comprising:

removing a test portion of lubricant from an engine of the mobile vehicle during a first maintenance period;

determining at least one quality parameter associated with the test portion of lubricant;

using the at least one quality parameter to determine a replacement quantity of lubricant less than all of the lubricant in the engine that must be removed from the engine and replaced with fresh lubricant in order to maintain a desired engine lubricant quality parameter in the engine during operation of the engine until a second maintenance period; and removing the replacement quantity of lubricant from the engine and replacing the removed lubricant with fresh lubricant.

2. The method of claim 1, further comprising repeating during the second maintenance period the steps of removing a test portion of lubricant, determining at least one quality parameter, using the at least one quality parameter to determine a replacement quantity of lubricant, and removing the replacement quantity of lubricant.

3. The method of claim 1, further comprising:

removing the test portion of lubricant from the engine at a first maintenance location;

delivering the test portion of lubricant to an analysis location remote from the first maintenance location; and communicating the replacement quantity to one of the first maintenance location and a second maintenance location for performing the steps of removing the replacement quantity of lubricant and replacing it with fresh lubricant.

4. The method of claim 3, further comprising using a global information network during the step of communicating.

5. The method of claim 3, further comprising:

determining the at least one quality parameter at the analysis location;

communicating the at least one quality parameter from the analysis location to a diagnostic location;

determining the replacement quantity of lubricant at the diagnostic location; and communicating the replacement quantity from the diagnostic location to one of the first maintenance location and the second maintenance location.

6. The method of claim 5, further comprising using a global information network during the steps of communicating the at least one quality parameter and communicating the replacement quantity.

7. The method of claim 3, further comprising transferring the replacement quantity of lubricant from the engine to a fuel tank of a mobile vehicle.

8. The method of claim 7, further comprising:

transferring the replacement quantity of lubricant from the engine to a storage apparatus to create a mixture of fuel and replaced lubricant; and transferring at least a portion of the mixture of fuel and replaced lubricant to the fuel tank.

9. The method of claim 1, further comprising adding fresh lubricant to the engine in an amount equal to a greater of the replacement quantity and a quantity necessary to fill the engine to a desired level.

10. The method of claim 1, further comprising determining the replacement quantity of lubricant by taking into account at least one of the group of a feature of the lubricant, an age of the engine, a duty cycle of the engine, and a season of operation.

11. A method for maintaining the quality of lubricant in the engine of a locomotive, the method comprising:

measuring a quality parameter of lubricant in an engine of a locomotive;

using the measured quality parameter value to project whether or not the quality parameter will drop below a predetermined limit during operation of the locomotive until a following maintenance period;

if the quality parameter is projected to remain above the predetermined limit until the following maintenance period, then replacing none of the lubricant in the engine; and if the quality parameter is projected to drop below the predetermined limit before the following maintenance period, then calculating an amount of lubricant that must be replaced with fresh lubricant in order to ensure that the quality parameter of the lubricant in the engine will remain above the predetermined limit until the following maintenance period, and replacing only that amount of the lubricant in the engine with fresh lubricant.

12. The method of claim 11, further comprising:

measuring the quality parameter at a fuel pad; and communicating a decision whether or not to replace lubricant to a service location where the locomotive will be serviced down-rail of the fuel pad.

13. The method of claim 12, further comprising:

measuring the quality parameter at the fuel pad with a hand-held permittivity sensor; and communicating the decision to the service location prior to arrival of the locomotive at the service location.

14. The method of claim 11, further comprising:

measuring the quality parameter on-board the locomotive; and communicating a decision whether or not to replace lubricant to a service location where the locomotive will be serviced down-rail of a fuel pad prior to arrival of the locomotive at the service location.

15. The method of claim 11, further comprising projecting whether or not the quality parameter will drop below the predetermined limit during operation of the locomotive until the following maintenance period by taking into account at least one of the group of a feature of the lubricant, an age of the engine, a duty cycle of the engine, a design of the locomotive, a rail system on which the locomotive is operating, and a season of operation.

* * * * *